US012279724B2

(12) United States Patent
Sauceda et al.

(10) Patent No.: US 12,279,724 B2
(45) Date of Patent: Apr. 22, 2025

(54) POTTY TRAINING SYSTEM

(71) Applicant: FRIDABABY,LLC, Miami, FL (US)

(72) Inventors: Samuel Sauceda, El Serino, CA (US); Bailey Denton, Miami, FL (US); Chelsea Hirschhorn, Miami, FL (US)

(73) Assignee: FRIDABABY, LLC, Miami, FL (US)

( * ) Notice: Subject to any disclaimer, the term of this patent is extended or adjusted under 35 U.S.C. 154(b) by 185 days.

(21) Appl. No.: 18/304,623

(22) Filed: Apr. 21, 2023

(65) Prior Publication Data

US 2024/0349956 A1 Oct. 24, 2024

(51) Int. Cl.
*A47K 11/04* (2006.01)
*A47K 17/02* (2006.01)

(52) U.S. Cl.
CPC ..... *A47K 11/04* (2013.01); *A47K 17/028* (2013.01)

(58) Field of Classification Search
CPC ..... A47K 11/04; A47K 17/028
USPC ..... 4/483
See application file for complete search history.

(56) References Cited

U.S. PATENT DOCUMENTS

| | | | |
|---|---|---|---|
| 8,462 | A | 10/1851 | Willmot |
| 43,499 | A | 7/1864 | Hidden |
| 53,632 | A | 4/1866 | Knight |
| 82,099 | A | 9/1868 | Farson |
| 155,319 | A | 9/1874 | Larrabee |
| 178,304 | A | 6/1876 | Kolb |
| 198,865 | A | 1/1878 | Whitnum |
| 228,539 | A | 6/1880 | Lane |
| 248,444 | A | 10/1881 | Gafney |
| 253,519 | A | 2/1882 | Drew |
| 612,076 | A | 10/1898 | Weston |
| 637,911 | A | 11/1899 | Weston |
| 672,912 | A | 4/1901 | Miles |
| 1,520,304 | A | 12/1924 | Nye |
| 1,737,163 | A | 11/1929 | Keppinger |
| 1,867,674 | A | 7/1932 | Mccandless |
| 2,255,272 | A | 9/1941 | Rasmussen |
| 2,266,641 | A | 12/1941 | Joyce et al. |
| 2,361,677 | A | 10/1944 | Bramhall |
| 2,402,832 | A | 6/1946 | Muller |
| 2,446,381 | A | 8/1948 | Middleton |

(Continued)

FOREIGN PATENT DOCUMENTS

| | | | |
|---|---|---|---|
| DE | 1554591 | A1 | 2/1970 |
| JP | 54143755 | U | 5/1979 |
| JP | 2002000507 | A | 1/2002 |

*Primary Examiner* — Huyen D Le
(74) *Attorney, Agent, or Firm* — Seyfarth Shaw LLP

(57) ABSTRACT

A potty training system includes a base, a platform, a basin and a topper. In a first configuration, the platform is installed on top of the base, the basin is supported by its support flange on the platform so as to occupy a central hole of the platform, and the topper is installed on top of the platform and basin. The platform, basin and topper are keyed to each other. An inner surface of a basin pour spout intentionally is spaced from an outer surface of a downwardly depending topper ring. Instead of keying to the inner surface of the basin pour spout, the topper has a downwardly extending blade that is received in a blade receptacle spaced from an inner margin of the platform. In a second configuration, the base is inverted and used as a step, the basin and platform are not used and the topper is placed to span an adult toilet seat.

19 Claims, 13 Drawing Sheets

(56) References Cited

U.S. PATENT DOCUMENTS

| | | | | |
|---|---|---|---|---|
| 2,516,557 | A | 7/1950 | Frazee et al. | |
| 2,518,272 | A | 8/1950 | Beckwith | |
| 2,539,660 | A | 1/1951 | Dunn et al. | |
| 2,645,784 | A | 7/1953 | Blackburn | |
| 2,662,229 | A | 12/1953 | Wenkstern | |
| 2,676,332 | A | 4/1954 | Inman | |
| 2,749,972 | A | 6/1956 | Markkula | |
| 2,804,121 | A | 8/1957 | Singleton | |
| 2,955,296 | A | 10/1960 | Zapolski | |
| 3,153,248 | A | 10/1964 | Miller | |
| 3,340,546 | A | 9/1967 | Moore et al. | |
| 3,371,356 | A | 10/1968 | Benjamin | |
| 3,428,967 | A | 2/1969 | Hughes | |
| 3,601,822 | A | 8/1971 | Weiss | |
| 3,609,775 | A | 10/1971 | Leiter et al. | |
| 4,161,793 | A | 7/1979 | Merchan | |
| 4,461,046 | A | 7/1984 | Adams | |
| 4,503,571 | A | 3/1985 | Sidney | |
| 4,635,303 | A | 1/1987 | Shih | |
| 4,777,672 | A | 10/1988 | Gebhard et al. | |
| 4,807,308 | A | 2/1989 | Person et al. | |
| 5,060,319 | A | 10/1991 | Laroue | |
| 5,161,263 | A | 11/1992 | Geneve et al. | |
| 5,170,516 | A | 12/1992 | Davison | |
| 5,182,818 | A | 2/1993 | Nawoj | |
| 5,524,295 | A | 6/1996 | Ford | |
| 5,685,029 | A | 11/1997 | Gee | |
| 5,778,460 | A | 7/1998 | Doell et al. | |
| 5,779,306 | A | 7/1998 | Ohlsson | |
| 5,787,518 | A | 8/1998 | Mendelovich et al. | |
| 5,809,584 | A | 9/1998 | Potts | |
| 6,052,840 | A | 4/2000 | West et al. | |
| 6,115,855 | A | 9/2000 | Lorenzo | |
| 6,598,240 | B1 | 7/2003 | Chang et al. | |
| 6,615,416 | B1 | 9/2003 | Chapman | |
| 6,698,036 | B2 | 3/2004 | Armbruster et al. | |
| 6,704,948 | B2 | 3/2004 | Shirkey | |
| 6,813,786 | B1 | 11/2004 | Pier et al. | |
| 6,968,578 | B2 | 11/2005 | Bernsley | |
| 7,150,050 | B2 | 12/2006 | Sharp | |
| 7,334,273 | B2 | 2/2008 | Thomas | |
| 7,409,731 | B1 | 8/2008 | Arteaga et al. | |
| 7,461,411 | B2 | 12/2008 | Wolf | |
| 7,631,370 | B2 | 12/2009 | Dunn et al. | |
| 7,634,822 | B2 | 12/2009 | Smithson | |
| 7,665,157 | B2 | 2/2010 | Deutsch | |
| D615,667 | S | 5/2010 | Dunn et al. | |
| 7,712,159 | B2 | 5/2010 | Stringer | |
| 7,770,242 | B2 | 8/2010 | Sell | |
| 7,779,489 | B2 | 8/2010 | Finell | |
| 7,891,030 | B1 | 2/2011 | Sutton | |
| 7,975,326 | B1 | 7/2011 | Wilson | |
| 8,079,097 | B2 | 12/2011 | Deutsch | |
| 8,276,219 | B2 | 10/2012 | Dubiel | |
| D716,919 | S | 11/2014 | Yeung | |
| 8,893,317 | B2 | 11/2014 | Smith | |
| 9,027,173 | B2 | 5/2015 | Dunn et al. | |
| 9,398,835 | B2 | 7/2016 | Mccarthy et al. | |
| 9,596,965 | B2 | 3/2017 | Sundberg et al. | |
| 9,715,836 | B2 | 7/2017 | Berkovich | |
| 9,750,378 | B2 | 9/2017 | Rathbone | |
| 9,848,744 | B1 | 12/2017 | Hobbs | |
| 9,936,843 | B2 | 4/2018 | Marsden et al. | |
| 9,994,393 | B2 | 6/2018 | Dunn et al. | |
| 10,053,284 | B2 | 8/2018 | Dunn et al. | |
| 10,076,214 | B2 | 9/2018 | Goh Aow | |
| 10,086,996 | B2 | 10/2018 | Dunn et al. | |
| D834,691 | S | 11/2018 | Yang | |
| 10,478,024 | B2 | 11/2019 | Del Duke et al. | |
| 10,478,025 | B2 | 11/2019 | Dunn et al. | |
| 10,517,447 | B2 | 12/2019 | Nye | |
| 10,524,623 | B2 | 1/2020 | Halonen et al. | |
| 10,710,799 | B2 | 7/2020 | Dunn et al. | |
| D892,284 | S | 8/2020 | Healy | |
| 10,758,098 | B2 | 9/2020 | Gharibian et al. | |
| D898,883 | S * | 10/2020 | Jin | D23/296 |
| 10,906,737 | B2 | 2/2021 | Dunn et al. | |
| D918,354 | S | 5/2021 | Xu | |
| 11,330,942 | B1 * | 5/2022 | Bergman | A47K 11/04 |
| 11,602,249 | B2 * | 3/2023 | Yang | A47K 11/06 |
| 2007/0101482 | A1 | 5/2007 | Dunn et al. | |
| 2008/0263756 | A1 * | 10/2008 | Marsden | A47K 11/06 4/239 |
| 2012/0084907 | A1 | 4/2012 | Dunn et al. | |
| 2012/0084908 | A1 | 4/2012 | Dunn et al. | |
| 2012/0084909 | A1 * | 4/2012 | Dunn | A47K 11/06 4/483 |
| 2016/0167872 | A1 | 6/2016 | Dunn et al. | |
| 2016/0167873 | A1 | 6/2016 | Dunn et al. | |
| 2016/0167874 | A1 | 6/2016 | Dunn et al. | |
| 2018/0290828 | A1 | 10/2018 | Dunn et al. | |
| 2020/0239227 | A1 | 7/2020 | Dunn et al. | |
| 2020/0339343 | A1 | 10/2020 | Dunn et al. | |
| 2021/0085135 | A1 | 3/2021 | Healy et al. | |
| 2021/0155404 | A1 | 5/2021 | Dunn et al. | |
| 2024/0341546 | A1 * | 10/2024 | Yang | A47K 11/04 |

* cited by examiner

POTTY TRAINING SYSTEM

BACKGROUND OF THE INVENTION

It is well known to provide apparatus for training young children to go to the bathroom in prescribed vessels, with an ultimate aim of encouraging them to perform all of their urination and defecation on an adult toilet. Among the issues to be addressed is the fact that non toilet-trained children usually are much smaller than adults. Many commodes and potties have been provided that are considerably smaller in their dimensions than adult toilets. Some of these prior potty training systems are convertible between a first configuration in which they are used as a separate commode and a second configuration during which they act as platforms suspended across adult toilet seats.

A child potty must also include a basin for catching the child's urine and feces. Ideally a child potty has a urine shield positioned to the front of the child, because the child under training, particularly if male, may urinate in a direction other than downward. It would further be advantageous for the child potty to have a topper formed of a soft, cushionable material, so configured that its soiling is minimized and so that it is supported by a structural member capable of bearing the child's weight without undue deflection. It would also be advantageous for different components of a child potty system to be keyed to each other so that they can be assembled in only one way.

SUMMARY OF THE INVENTION

According to one aspect of the invention, a potty training system is provided that includes a base, a platform, a basin and a topper. The base is hollow, has a top rim and like the other components is disposed on a vertical axis. The platform is removably mounted on the top rim of the base and has a central opening defined by a circumferential platform inner margin. The basin has a top margin and a hollow interior bounded by a circumferential basin sidewall. The basin sidewall has a basin end wall. A support flange of the basin extends laterally outwardly from the basin top margin. The sidewall of the basin is adapted to be removably received in the platform central opening such that the support flange supports the basin on the platform. A pour spout of the basin is formed to radially outwardly protrude from the outer surface of the basin end wall. A pour spout outer surface is a portion of an outer surface of the basin end wall, while a pour spout inner surface is a portion of an inner surface of the basin end wall. The topper is removably mounted on the platform and has a lower surface. A topper central opening communicates with the hollow interior of the basin. When the topper is mounted on the platform, a topper ring downwardly extends from the topper lower surface, through the platform central opening and into the hollow interior of the basin. An outer surface of the topper ring is inwardly spaced from the inner surface of the pour spout. An end portion of the platform margin has an outwardly extending pour spout notch that is adapted to receive the outer surface of the pour spout. A blade receptacle is formed in the platform to downwardly extend from the platform top surface and to be spaced radially outwardly from the pour spout notch. A topper blade downwardly depends from the topper lower surface. The topper blade is radially outwardly spaced from the topper ring and is adapted to be received in the blade receptacle when the topper is assembled to the platform.

In one embodiment, the basin sidewall further has at least a first basin lug that is formed to downwardly extend from the support flange of the basin and to laterally outwardly protrude from the outer surface of the basin sidewall. The first basin lug is angularly spaced around the vertical axis from the pour spout of the basin. A first platform lug notch is formed in the platform margin to be angularly spaced around the axis from the pour spout notch, and is adapted to receive the outer surface of the first basin lug. A first topper lug is formed to outwardly protrude from the outer surface of the topper ring, and is angularly spaced around the axis from the topper blade. The first topper lug is received by an inner surface of the first basin lug when the topper is assembled to the platform and the basin.

In one embodiment, the basin sidewall has an upper portion and a lower portion, joined by a circumferential and horizontally extending step. When the topper and the basin are assembled to the platform, an inner surface of the topper ring is substantially aligned with an inner surface of the lower portion of the basin sidewall. In one embodiment, the pour spout of the basin outwardly protrudes from both the lower portion and the upper portion of the basin sidewall. In this embodiment an inner surface of the basin pour spout is not stepped.

Optionally, a flexible and fluid-impermeable liner may be inserted into the hollow interior of the basin. A wall of the liner is fitted over the top surface of the support flange and is drawn underneath the bottom surface of the support flange, so as to be clamped between the bottom surface of the support flange and the platform top surface.

In one embodiment, the potty training system is configurable to each of first and second configurations. In the first configuration, the basin is suspended by its support flange on the platform top surface, the platform bottom surface is supported by the top rim of the base, and the topper is supported by the platform top surface. In the second configuration, the base is inverted such that the top rim of the basin contacts the floor and such that the bottom surface of the base faces upward to become a step surface. The topper is removed from the base and placed to span a central opening of an adult toilet seat. The basin and platform are not used in the second configuration.

In one embodiment, the platform has a left wing that extends outwardly from the left side of the platform outer margin, and a right wing that extends outwardly from the right side of the platform outer margin. The topper has a left handle that outwardly extends from a left side of a topper outer margin, and a right handle that outwardly extends from a right side of the topper outer margin. The left handle is supported by the left wing of the platform while the right handle is supported by the right wing of the platform. A right hand cutout is formed as a cavity in the bottom surface of the right handle and a left hand cutout is formed as a cavity in the bottom surface of the left handle. These cutouts afford locations where the training child may insert his or her hands.

According to another aspect of the invention, a potty training system includes a base disposed on a vertical axis and having a top rim. A platform is removably mounted on the top rim of the base and has a platform central opening defined by a circumferential platform inner margin. A basin is provided that has a hollow interior and a basin top margin. A basin sidewall downwardly extends from the top margin of the basin, and includes a basin front end wall and a basin rear end wall opposed to the basin front end wall. A support flange of the basin laterally outwardly extends from the basin top margin. The basin sidewall is adapted to be removably received in the platform central opening such that the support flange supports the basin on the platform top surface. A pour spout is formed in the basin to laterally outwardly protrude from the outer surface of the basin rear end wall. A pour spout outer surface is a portion of the outer surface of the basin rear end wall, while a pour spout inner surface is a portion of the inner surface of the basin rear end wall. A topper is provided that is removably mounted on the platform. When the topper is assembled to the platform and basin, a topper central opening communicates with the hollow interior of the basin. A topper ring downwardly extends from a lower surface of the topper, through the central opening of the platform and into the hollow interior of the basin. The outer surface of the topper ring is spaced from the pour spout inner surface. A rear end portion of the platform margin has an outwardly extending pour spout notch that is adapted to receive the outer surface of the pour spout. A blade receptacle is formed in the platform to downwardly extend from a top surface of the platform and to be laterally outwardly spaced from the pour spout notch. A topper blade downwardly extends from the topper lower surface, and so as to be outwardly spaced from the topper ring. The topper blade is adapted to be received in the blade receptacle of the platform when the topper is assembled to the platform. First and second basin lugs are formed to downwardly extend from the support flange of the basin and to laterally outwardly protrude from the outer surface of the basin sidewall. The first basin lug is disposed in the basin front end wall to be angularly spaced around the axis from the pour spout. The second basin lug is disposed in the basin front end wall to be angularly spaced around the axis from the first basin lug and the pour spout. First and second platform lug notches are formed in the platform margin to be angularly spaced around the axis from the pour spout notch and from each other. The first platform lug notch is adapted to receive the outer surface of the first basin lug, while the second platform lug notch is adapted to receive the outer surface of the second basin lug. First and second topper lugs are formed to outwardly protrude from the outer surface of the topper ring. The first topper lug is angularly spaced around the axis from the topper blade, while the second topper lug is angularly spaced around the axis from the topper blade and the first topper lug. When the topper is assembled to the platform and basin, the first topper lug is received by the inner surface of the first basin lug and the second topper lug is received by the inner surface of the second basin lug.

The components of the toilet training system are keyed to each other for error-free assembly. But, instead of having the outer surface of the topper ring conform to the inner surface of the pour spout, a separate, downwardly depending topper blade is provided that is keyed to a topper blade receptacle in the platform. In this manner, and in the instance that a liner is not used, the topper becomes less likely to be soiled by the contents of the basin.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
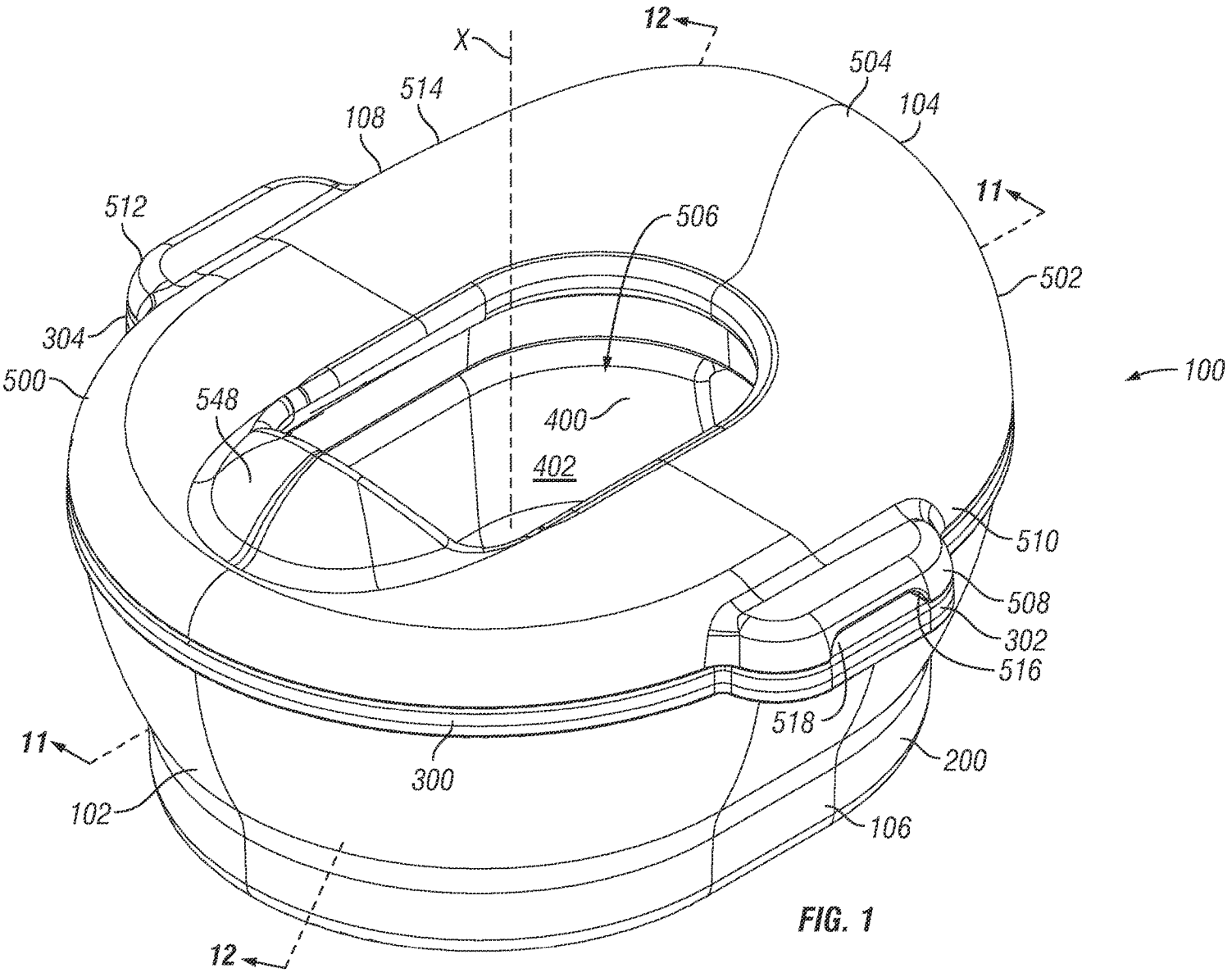
FIG. 1 is a top left perspective view of a potty training system according to the invention, as assembled into a first configuration.
Figure 2:
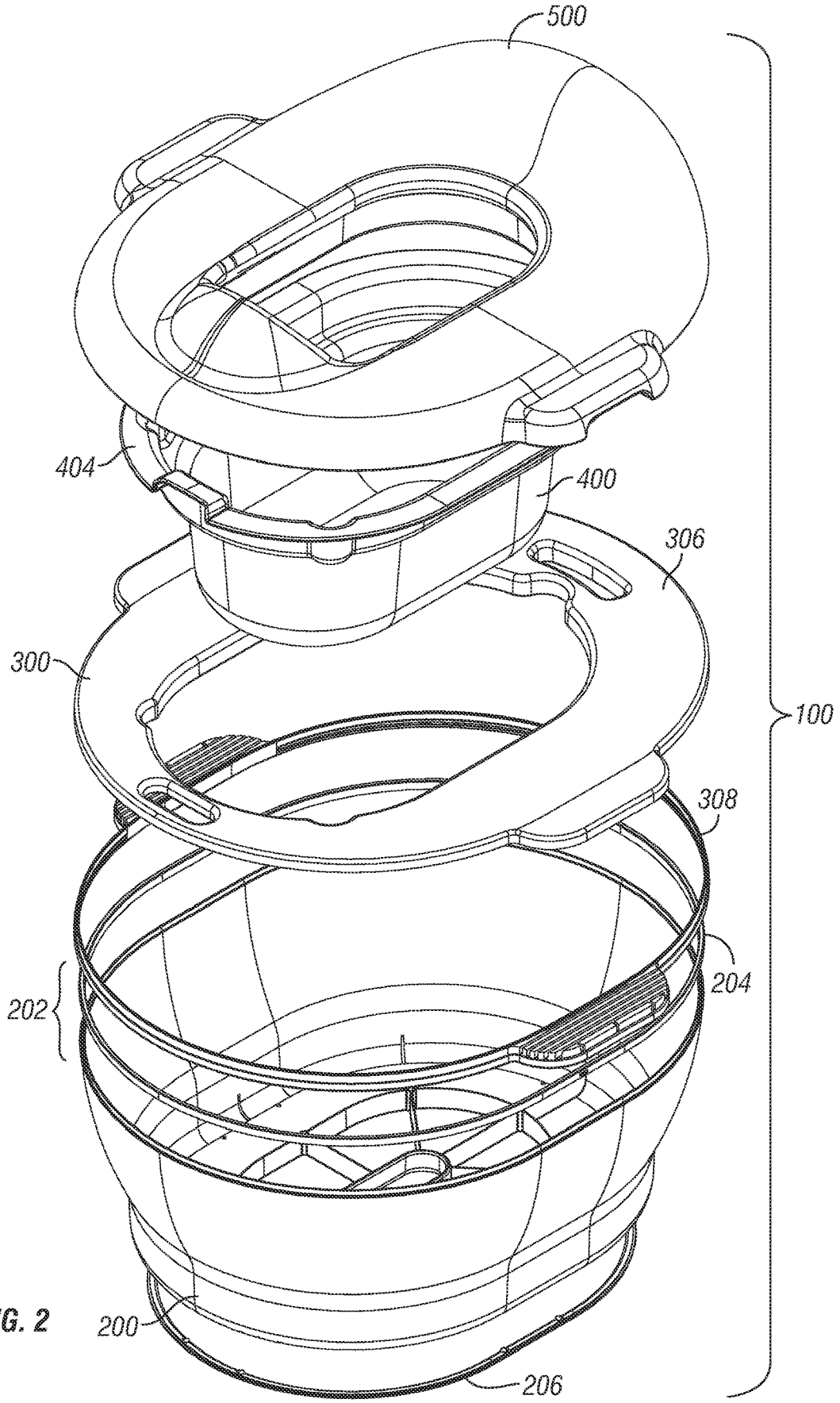
FIG. 2 is a perspective exploded view of the potty training system shown in FIG. 1.

Referring to FIGS. 1 and 2, the main components of a potty training system 100 according to the invention are a base 200, a platform 300, a basin 400 and a topper 500. FIG. 1 shows the components assembled together in a first configuration, in which the system 100 acts as a potty or commode. The assembled commode 100 has a front end 102 and an opposed rear end 104. A left side 106 and a right side 108 are opposed to each other and extend between the front end 102 and the rear end 104. As assembled in this first configuration, components 200, 300, 400 and 500 are disposed on a vertical axis X. In the illustrated embodiment, the commode 100 is longer than it is wide; that is, the distance, through axis X, between front end 102 and 104 is greater than the distance, through axis X, between left side 106 and right side 108. In the illustrated embodiment, the front end 102 and the rear end 104 are curved around axis X.

A rear end 502 of the topper 500 may have an elevated back 504 to guide the child's bottom into a position such that the child's bottom is positioned on or near axis X over a topper central opening 506. The topper central opening 506 communicates with a hollow interior 402 of the basin 400. The topper 500 has a left handle 508 which laterally and outwardly extends from a topper left side 510. The topper 500 has an opposed right handle 512 which laterally and outwardly extends from a topper right side 514. In the illustrated embodiment, a curved, upwardly extending urine shield 548 is disposed at the front of the central opening 506 of the topper.

In the illustrated embodiment, handle 508 has a lower surface 516 into which a cavity or cutout 518 is formed. The cutout 518 is open back to left side 510 and is sized and shaped to admit the fingers of a young child's hand. A similar cutout (not shown in FIG. 1; see 520 in FIG. 10) is formed on the bottom surface 522 of right handle 512. Outside of the cutouts 518, 520, the lower surface 516 of the left handle 512 is supported by a left wing 302 of the platform 300, and the lower surface 522 of the right handle 512 is supported by a right wing 304 of the platform 300. In general, the platform 300, which can be molded of a relatively harder plastic such as polypropylene or ABS, provides structural support for the topper 500. Topper 500 may be molded of a yieldable foamed elastomer such as foamed ethylene vinyl acetate (EVA).

The general arrangement of system 100 in its first configuration is shown in an exploded view in FIG. 2. The platform 300 rests on a top rim 202 of the base 200. A support flange 404 of the basin 400 rests on a top surface 306 of the platform 300. The topper 500 is supported by platform 300. The exploded view of FIG. 2 further shows an overmolded ring 204 that makes up the top rim 202, and an overmolded bottom ring 206 that is molded onto a bottom surface 208 of the base 200 (see FIG. 4). An overmold component 308 is molded onto a bottom surface 310 of the platform 300 (see FIG. 6). The overmold components 204, 206, 308 may be molded of thermoplastic polyurethane (TPU) while their substrates may be molded of polypropylene, ABS or another nonelastomeric plastic. While shown exploded off their respective substrates in FIG. 2, as provided to the consumer the elastomeric overmold components 204, 206, 308 will be permanently attached to those substrates to make up platform 300 and base 200, and are not separately removeable. In another embodiment, overmold components 204, 206 and 308 are omitted.

Figure 3:
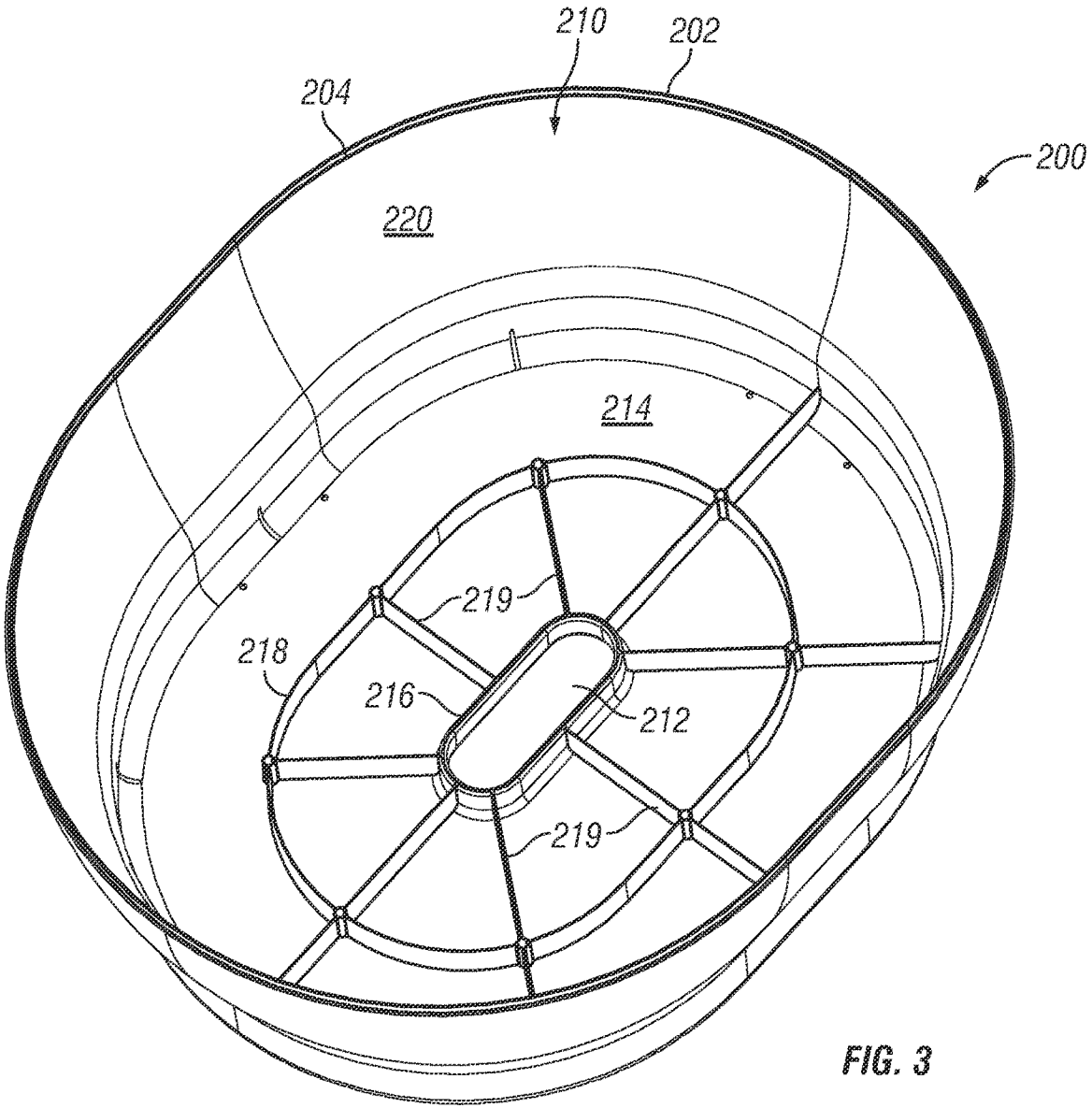
FIG. 3 is a top perspective view of a base used in the system depicted in FIGS. 1 and 2.
Figure 4:
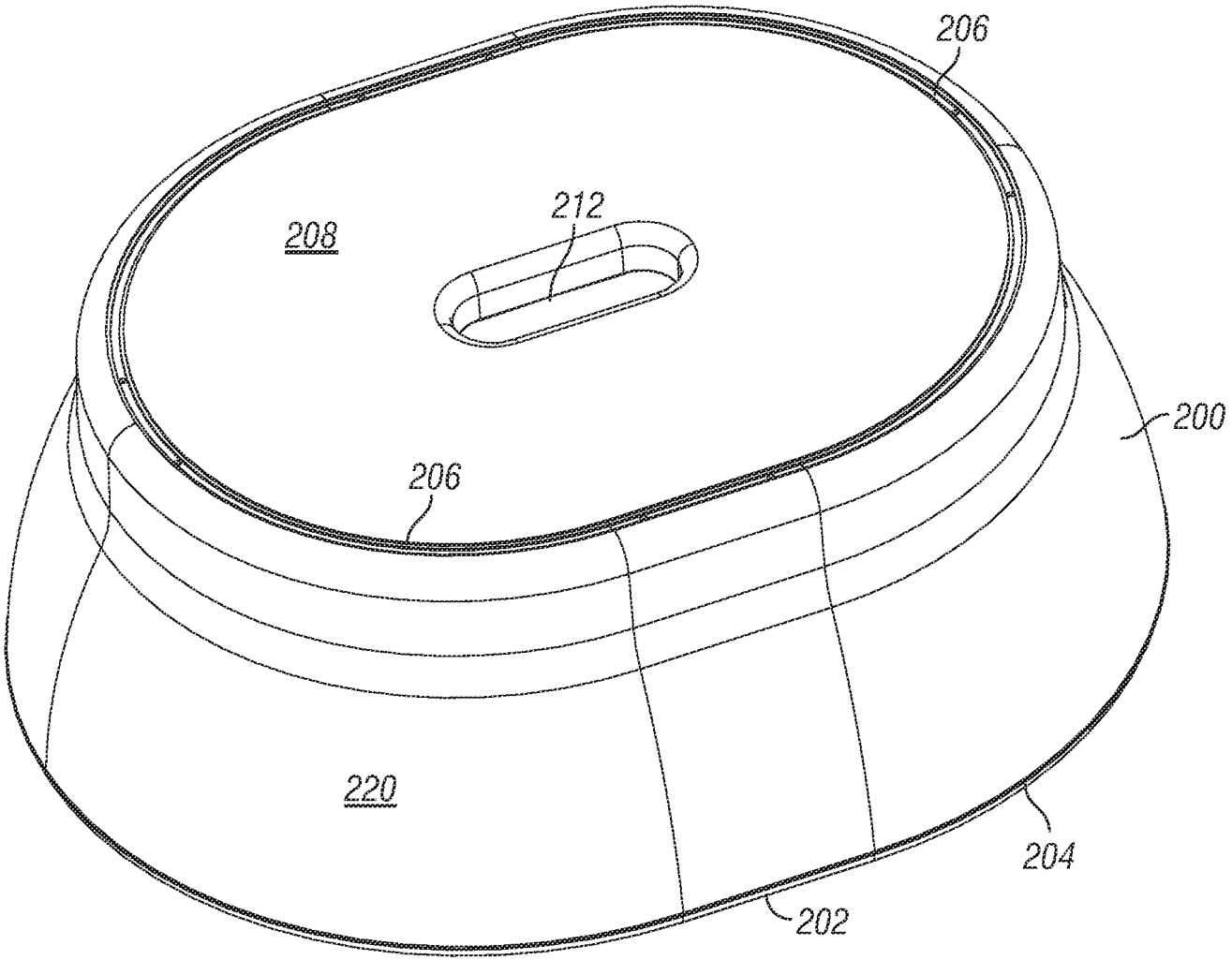
FIG. 4 is a bottom perspective view of the base depicted in FIG. 3.
Figure 13:
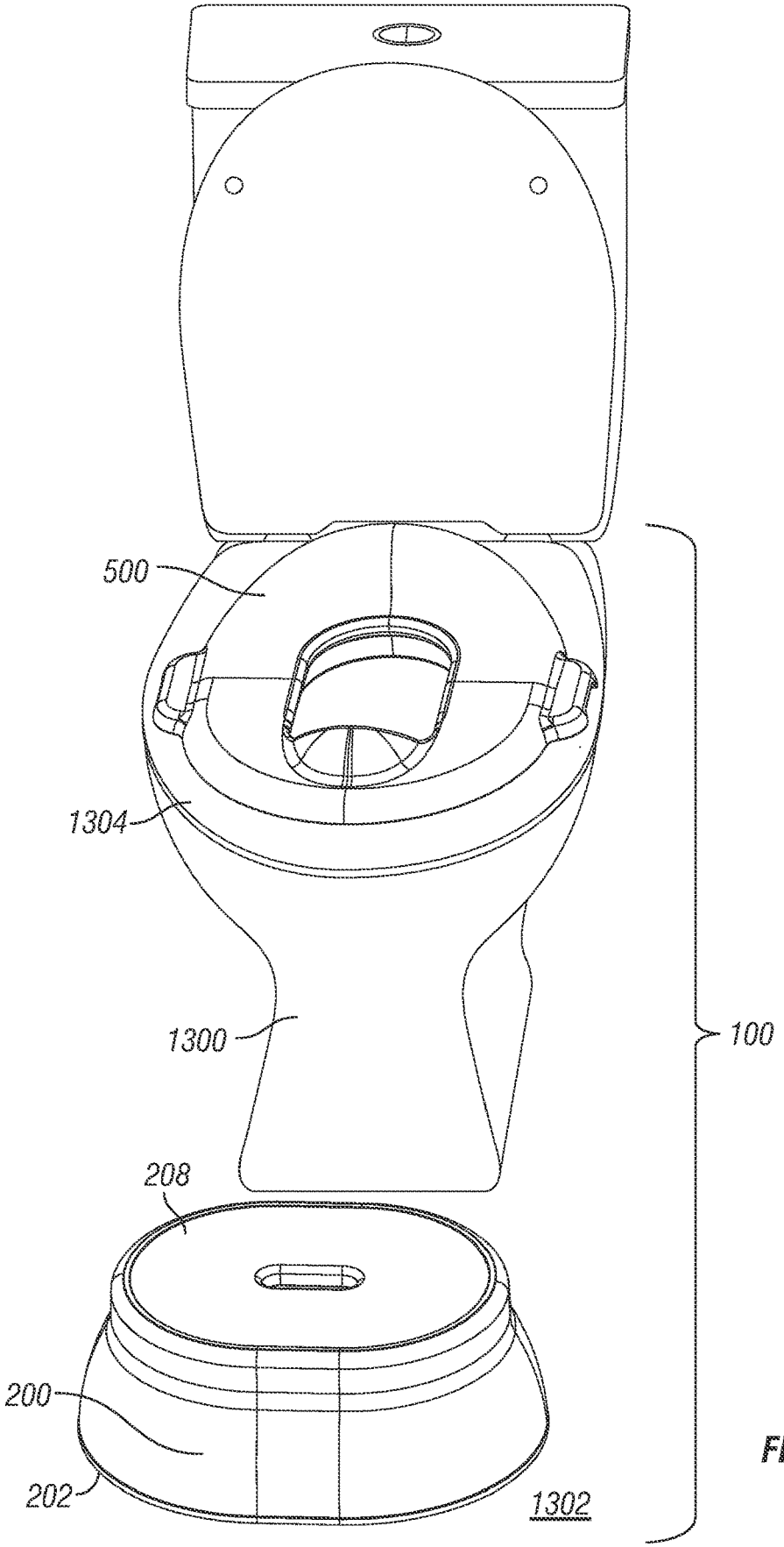
FIG. 13 is a perspective view of components of the potty training system depicted in FIG. 1, but showing the components in a second configuration.

As seen in FIG. 3, the base 200 has a hollow interior 210 that is deep enough to accommodate the basin 400. An oblong central hole 212 may be formed in a bottom panel 214 of the base 200, as surrounded by an endless reinforcing rib 216. The hole 212 may be used as a hand hole when positioning base 200 and also acts to equalize air pressure inside hollow interior 210 when the base 200 is inverted and used as a stool. A further endless reinforcing rib 218 upwardly extends from bottom panel 214 and is radially outwardly displaced from rib 216. A plurality of angularly spaced apart radial ribs 219 may be formed to stand up from panel 214 and to extend from rib 216 to a base sidewall 220. These reinforcing ribs come into play when the base 200 is inverted and used as a step stool in the system's second configuration (FIG. 13). Ribs 218 and 219 may take positions and forms other than those shown. The overmold ring 204 is optional, but if provided, provides a friction surface when platform 300 is installed on top of it, and also functions as a non-slip surface when the base 200 is inverted and used as a step stool (FIGS. 4 and 13).

Figure 5:
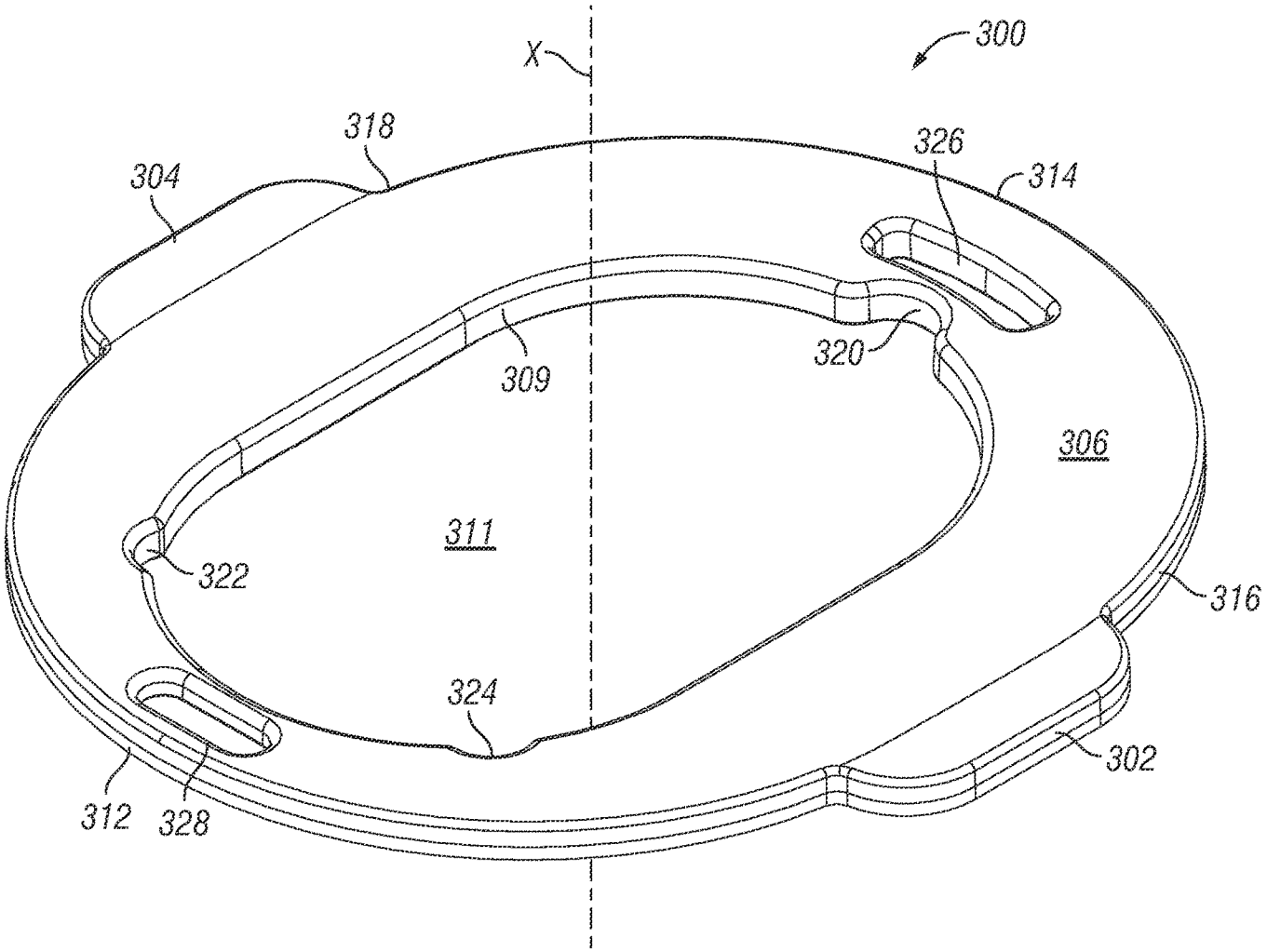
FIG. 5 is a top left perspective view of a platform used in the system depicted in FIGS. 1 and 2.

As seen in FIG. 5, the platform 300 has a circumferential inner margin 309 that defines a platform central opening 311. The top surface 306 of platform 300 may be flat. The platform 300 has a front end 312 and an opposed rear end 314, both of which are rounded in the illustrated embodiment. Front end 312 and rear end 314 are joined by left and right platform sides 316, 318. Left wing 302 radially outwardly protrudes from left side 316, while right wing 304 radially outwardly protrudes from right side 318. Wings 302, 304 may be angularly separated from each other by 180 degrees around axis X.

A concave pour spout notch 320 is formed in the inner margin 309 to be near rear end 314 and to be remote from front end 312. A first, right concave lug notch 322 is formed in the inner margin 309 near the front end 312 and to be remote from rear end 314. A second, left concave lug notch 324 is formed in the inner margin 309 near the front end 312 and to be remote from rear end 314. First lug notch is angularly spaced around axis X from second lug notch 324 and pour spout notch 320. Lug notches 322, 324 may be semicylindrical in shape.

Figure 6:
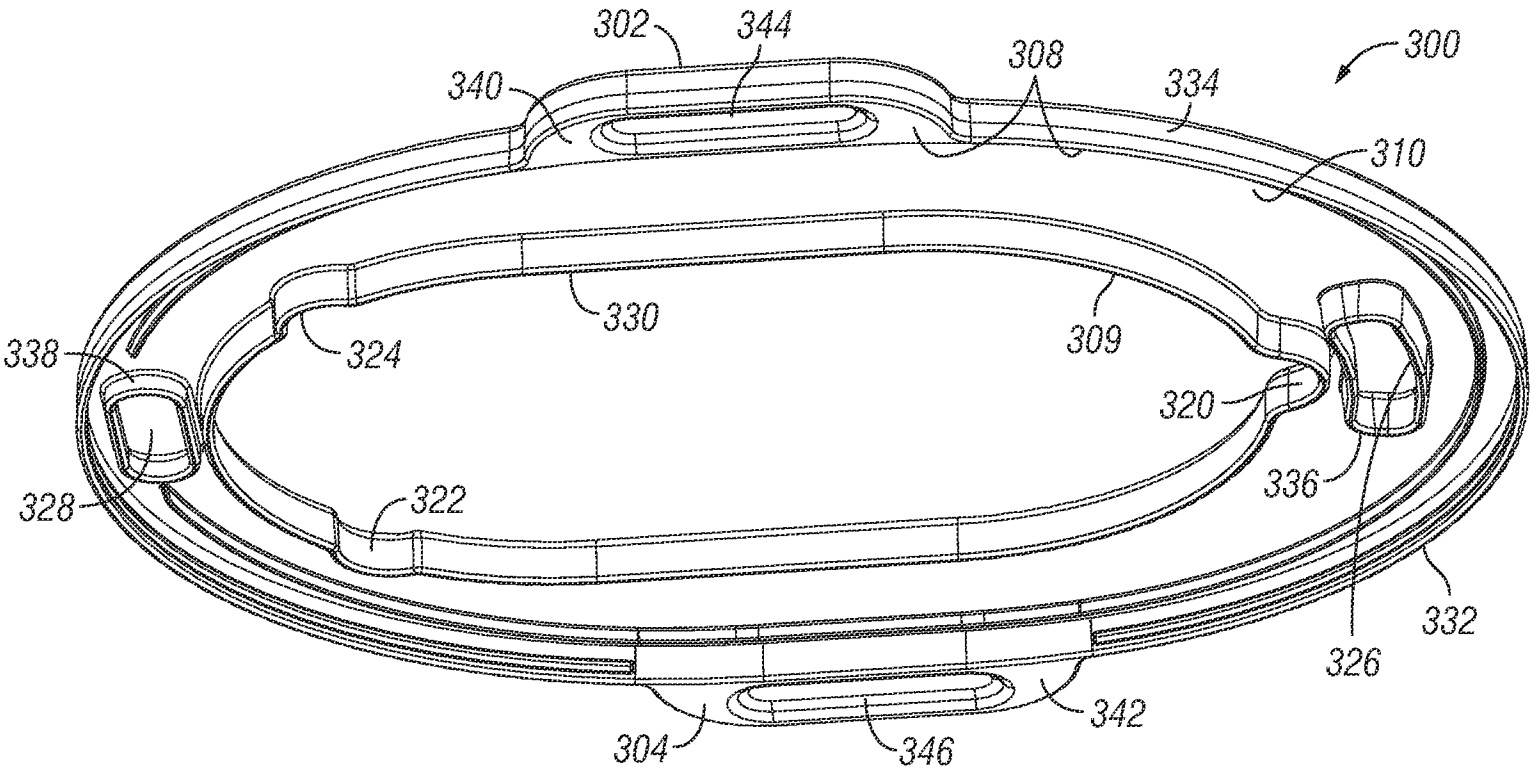
FIG. 6 is a bottom side perspective view of the platform depicted in FIG. 5.

A blade receptacle 326 extends from top surface 306 to bottom surface 310 (FIG. 6). The blade receptacle 326 can have a shape, in a plane orthogonal to axis X, that is noncircular, and may for example be elongate and slightly concave relative to axis X. The receptacle 326 is rearwardly spaced from the pour spout notch 320, and is disposed to be close to rear end 314 and far away from front end 312. The blade receptacle is angularly spaced around axis X from both lug notch 322 and lug notch 324. In the illustrated embodiment the platform 300 is much less deep than it is long or wide. Notches 320-324 downwardly extend for the entirety of the depth of platform 300.

As are system components 200, 400 and 500, the platform 300 can be longer (between ends 312 and 314) than it is wide (between sides 316 and 318). An elongate handle hole 328 may be formed in platform 300 to be radially outwardly spaced from inner margin 309 and near front end 312.

As seen in FIG. 6, a downwardly extending and endless reinforcing rib 330 may form the platform inner margin 309, the pour spout notch 320 and the lug notches 322 and 324. An outer margin 332 of the platform 330 may be constituted by a downwardly depending rib 334. The sidewall of blade receptacle 326 may be formed by a downwardly depending and endless rib 336. A sidewall of the handle hole 328 may be formed by a downwardly depending rib 338.

A lower surface 340 of the left wing 302, a lower surface 342 of the right wing 304, and the bottom margin of outer platform rib 334 may be constituted by a thermoplastic polyurethane (TPU) overmold component 308. Alternatively, overmold component 308 may be omitted. Lower surface 340 and lower surface 342 may be respectively provided with elongate hand cavities 344, 346 to receive the fingers of the training child or of an adult positioning the platform 300.

Figure 7:
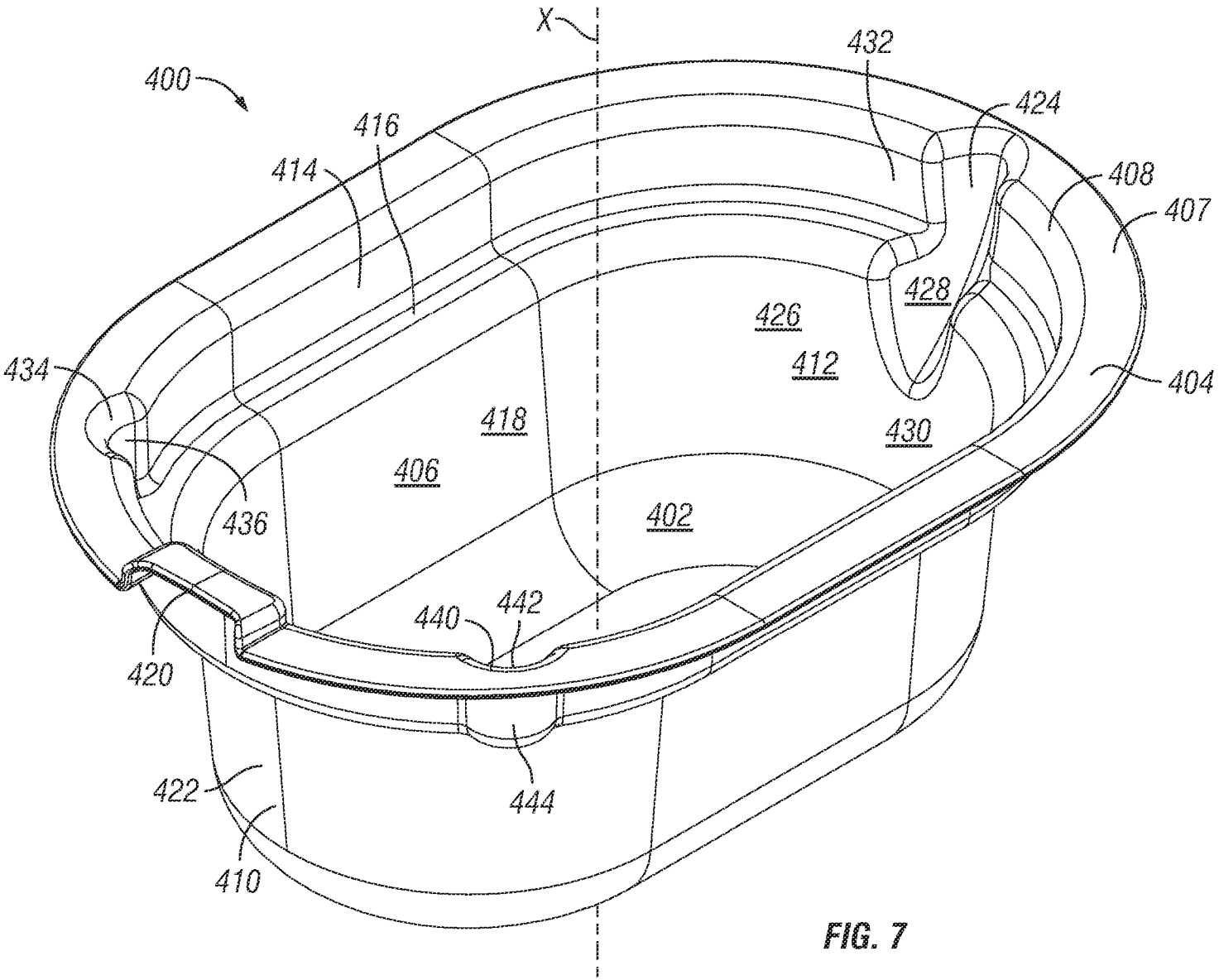
FIG. 7 is a top left perspective view of the basin used in the system depicted in FIGS. 1 and 2.

With reference to FIG. 7, The basin 400 is a thin-wall construction, with the shape of the outer/lower surface following the shape of the inner/upper surface. An endless sidewall 406 of the basin 400 downwardly depends from a top margin 408 thereof and extends around axis X. The sidewall 406 defines the horizontal limits of the basin hollow interior 402. The support flange 404 laterally or radially outwardly extends from the top margin 408. (As used herein, "laterally outwardly" means horizontally away from axis X, even where such displacement may not completely align with a radius in this oval-shaped system.) The support flange 404 has a substantially flat top surface 407. The sidewall 406 includes a front end wall 410 and an opposed, rear end wall 412. The sidewall 406 is also divided, in a vertical direction, among a top portion 414 that downwardly extends from top margin 408, a circumferential and substantially horizontal step 416 that radially inwardly extends from top portion 414, and a lower portion 418 that downwardly extends from an inner margin of step 416.

Most of the support flange 404 is flat and conforms to a horizontal plane orthogonal to axis X. An exception is a raised handle 420 that is formed at a front end 422 of the basin 400. The handle 420 is opposed to a pour spout 424 that is formed at a rear end 426, and in the rear end wall 412, of the basin 400. The pour spout 424 is an inwardly concave, upwardly and outwardly extending surface that starts at its intersection with lower sidewall portion 412 and continues through step 416 and upper portion 414 to open through support flange 404. In the illustrated embodiment, the pour spout 424 is not stepped. Pour spout 424 has an inner surface 428 that outwardly protrudes from the inner surfaces 430, 432 of lower and upper sidewall portions 418 and 414, and is monotonic.

A first, right basin lug 434 is formed to laterally outwardly protrude from upper portion inner surface 432 and to downwardly extend from top margin 408 and support flange 404.

Figure 9:
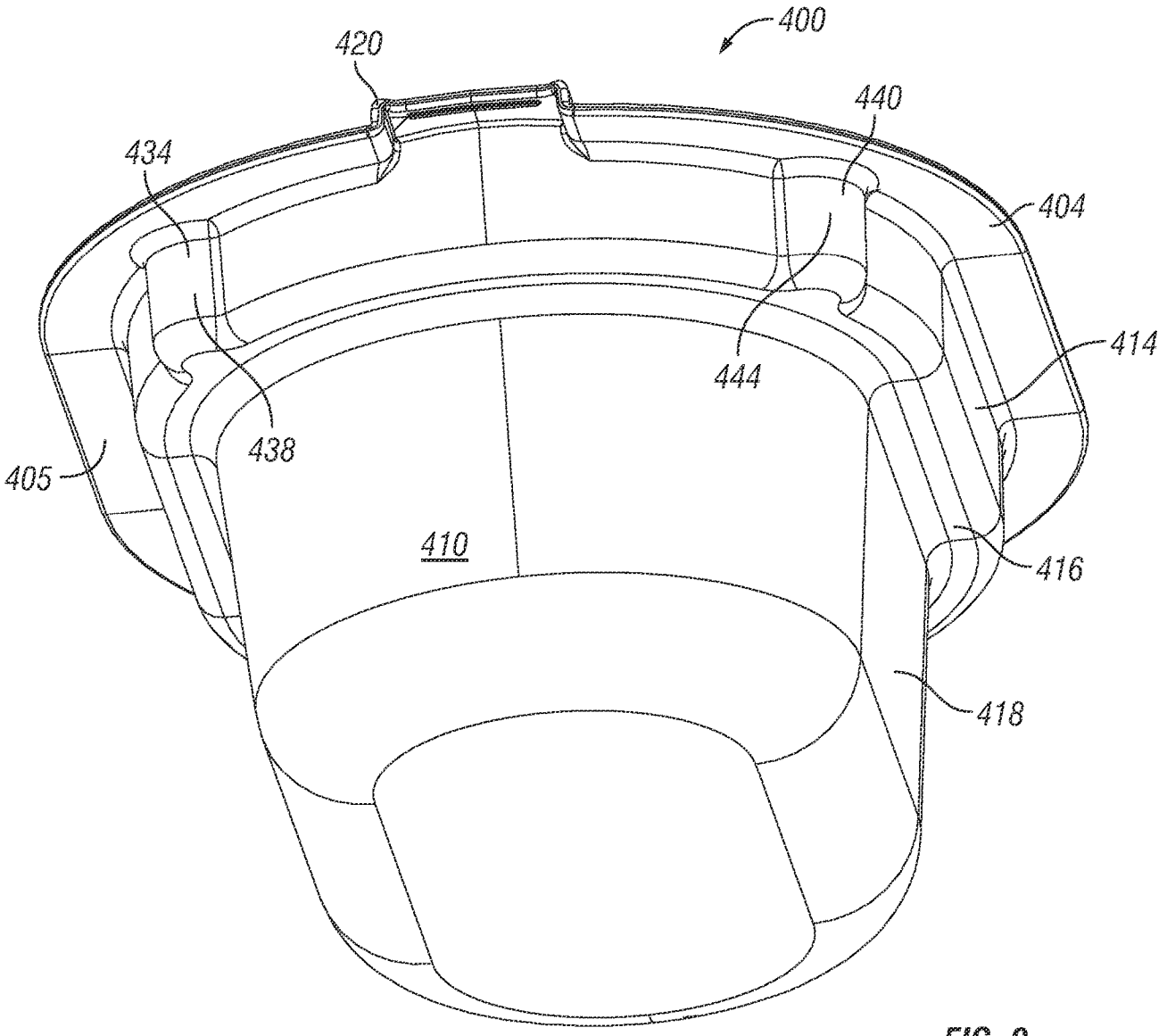
FIG. 9 is a bottom front perspective view of the basin depicted in FIGS. 7 and 8.

The first basin lug 434 has an inner surface 436 that faces the basin interior 402 and an opposed outer surface 438 (FIG. 9) that follows the shape of inner surface 436. A second, left basin lug 440 likewise outwardly protrudes from the upper portion inner surface 432 and downwardly extends from top margin 408 and support flange 404. The second basin lug 440 has an inner surface 442 that faces basin interior 402 and an opposed outer surface 444 that follows the contour of lug inner surface 442. Lugs 434 and 440 may take a semicylindrical shape and may terminate at their lower ends at step 416.

Figure 8:
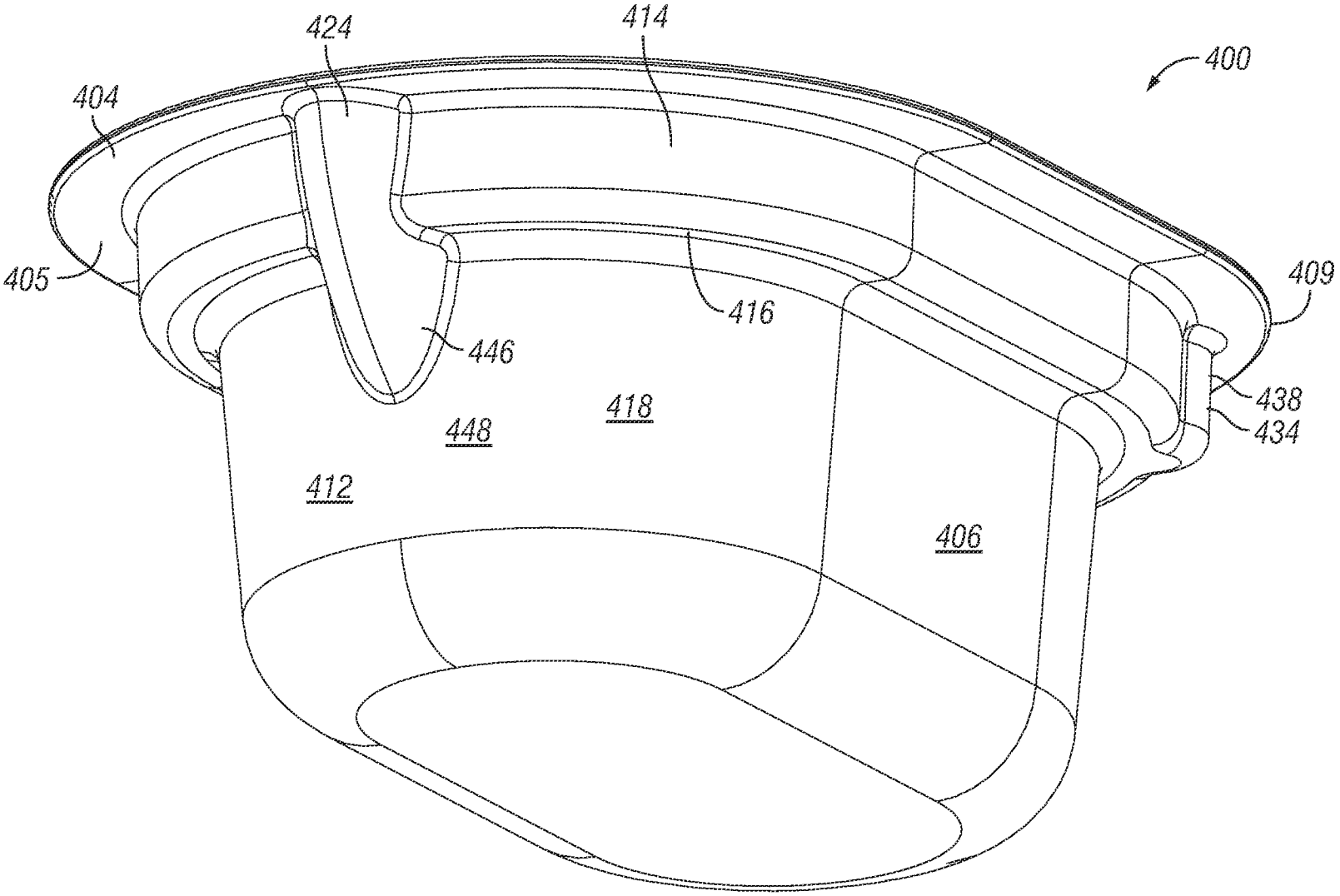
FIG. 8 is bottom right perspective view of the basin depicted in FIG. 7.

As seen in FIG. 8, an outer surface 446 of the pour spout 424 laterally outwardly protrudes from an outer surface 448 of the basin sidewall 406. The basin sidewall 406 is removably received in the platform central opening 311. The support flange 404 of the basin 400 has a flat lower surface 405.

Figure 10:
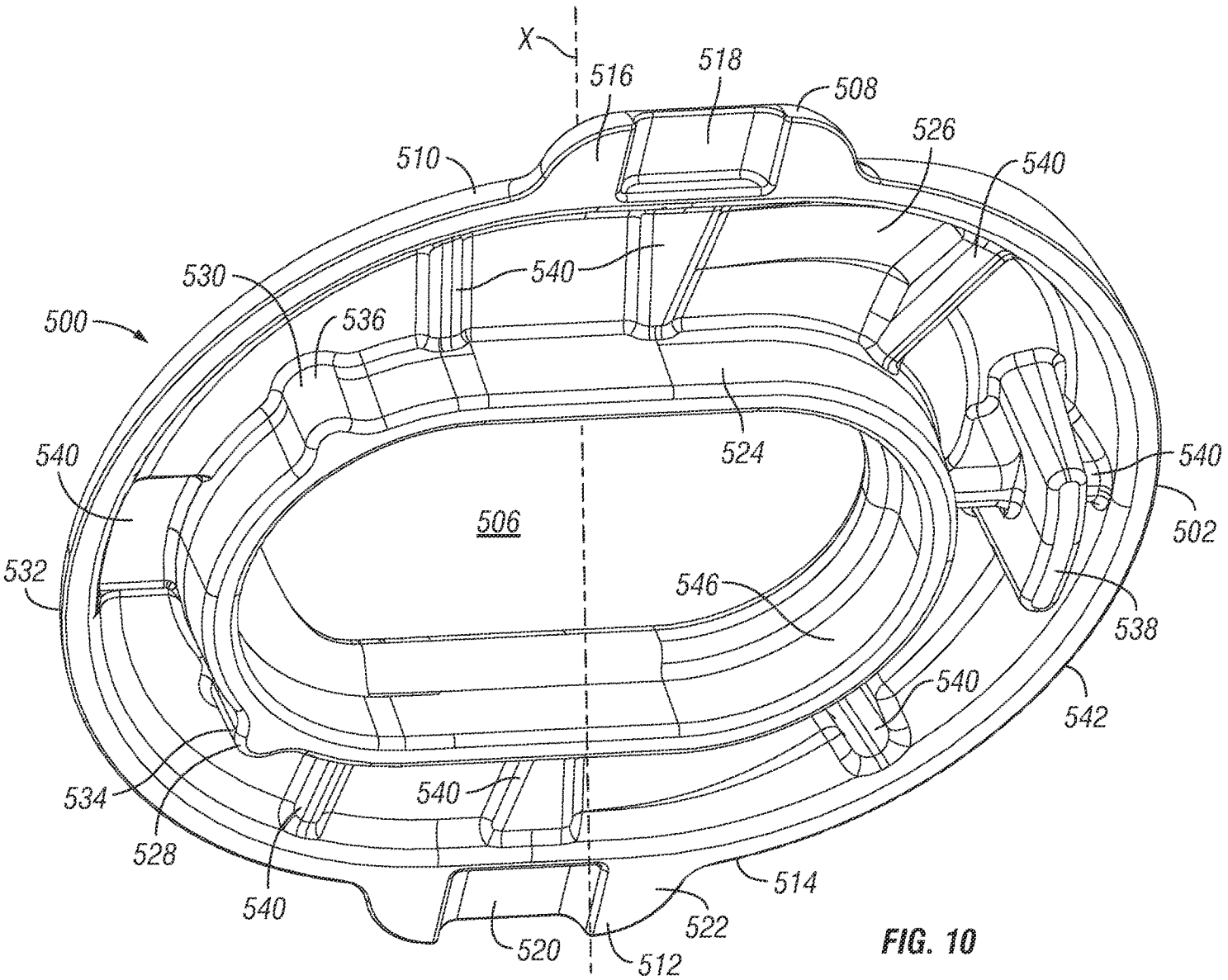
FIG. 10 is a bottom perspective view of a topper used in the system depicted in FIGS. 1 and 2.
Figure 12:
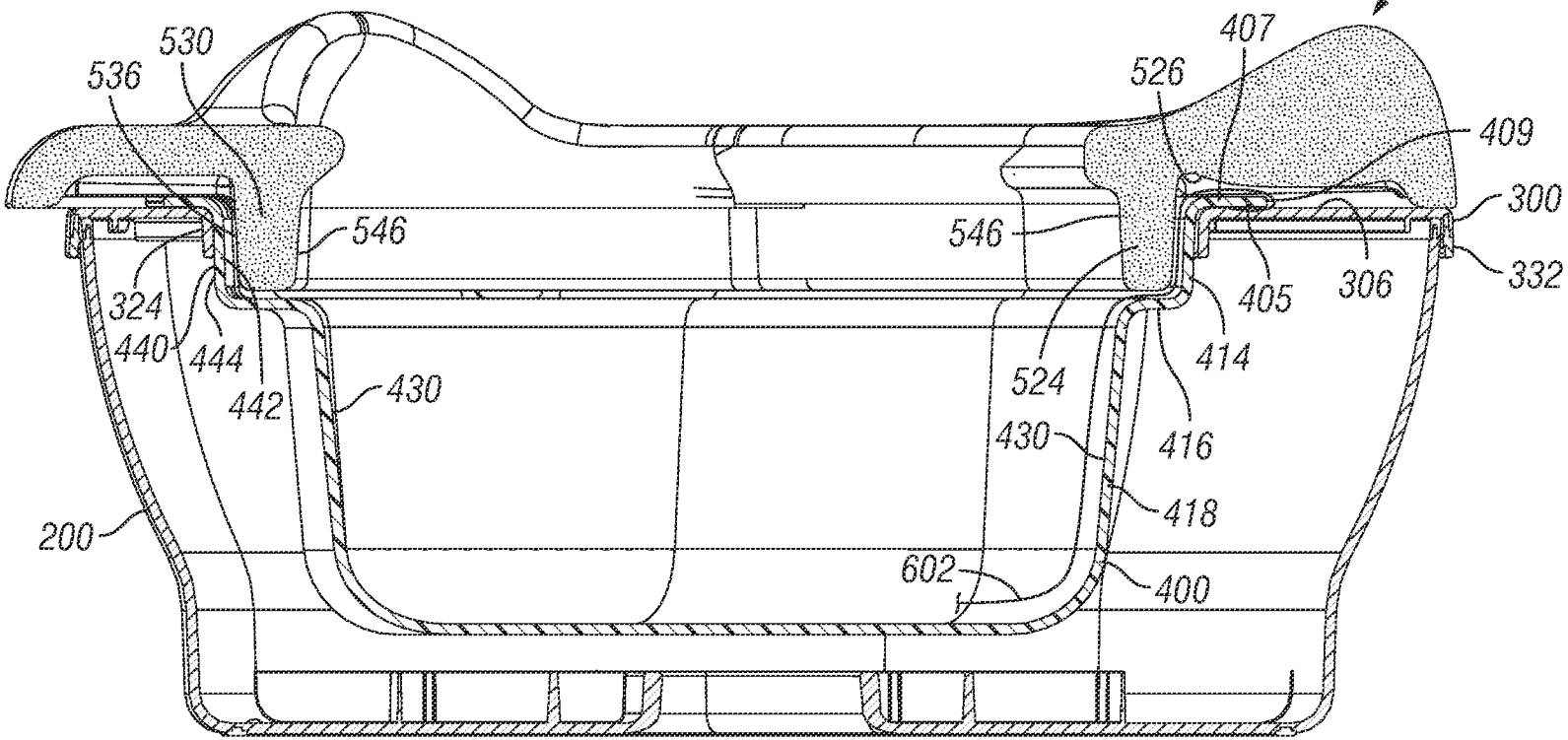
FIG. 12 is a sectional view taken substantially along Line 12-12 of FIG. 1.

Further details of the topper 500 can be seen in FIG. 10. A ring 524 downwardly depends from a topper bottom or lower surface 526 and extends around axis X, so as to surround the central opening 506. The ring 524 has a first, right topper lug 528 that laterally outwardly protrudes from ring 524 and, angularly spaced from first topper lug 528, a second, left topper lug 530 that likewise laterally outwardly protrudes from ring 524. Topper lugs 528 and 530 may be approximately semicylindrical in shape, with a little downward and inward draft to make their insertion into and removal from corresponding basin lugs 434 and 440 more easy. Topper lugs 528 and 530 have a vertical depth that is substantially the same as a vertical depth of topper ring 524. Topper lugs 528 and 530 are positioned near a front end 532 of topper 500 and to be remote from the rear end 502 thereof. When assembled, an outer surface 534 of topper lug 528 will be received by and will fit to inner surface 436 of first basin lug 434, while, as shown by FIG. 12, an outer surface 536 of second topper lug 530 will be received by and will fit to inner surface 442 of second basin lug 440 (FIG. 7).

Referring again to FIG. 10, a topper blade 538 downwardly extends from topper lower surface 526. The blade 538 is spaced rearwardly from ring 524, so as to be near topper rear end 502 and remote from the topper front end 532. Blade 538 may be noncircular in horizontal cross section and in the illustrated embodiment takes a somewhat flat, curved shape, concave in the direction of axis X. Blade 538 is angularly displaced around axis X from both right topper lug 528 and left topper lug 530.

In the illustrated embodiment, topper bottom surface 526 is not flat but rather is somewhat hollow, and has a set of downwardly extending reinforcing ribs 540 that also extend laterally outwardly from ring 524 to a downwardly depending, circumferential, outer rim or margin 542.

Figure 11:
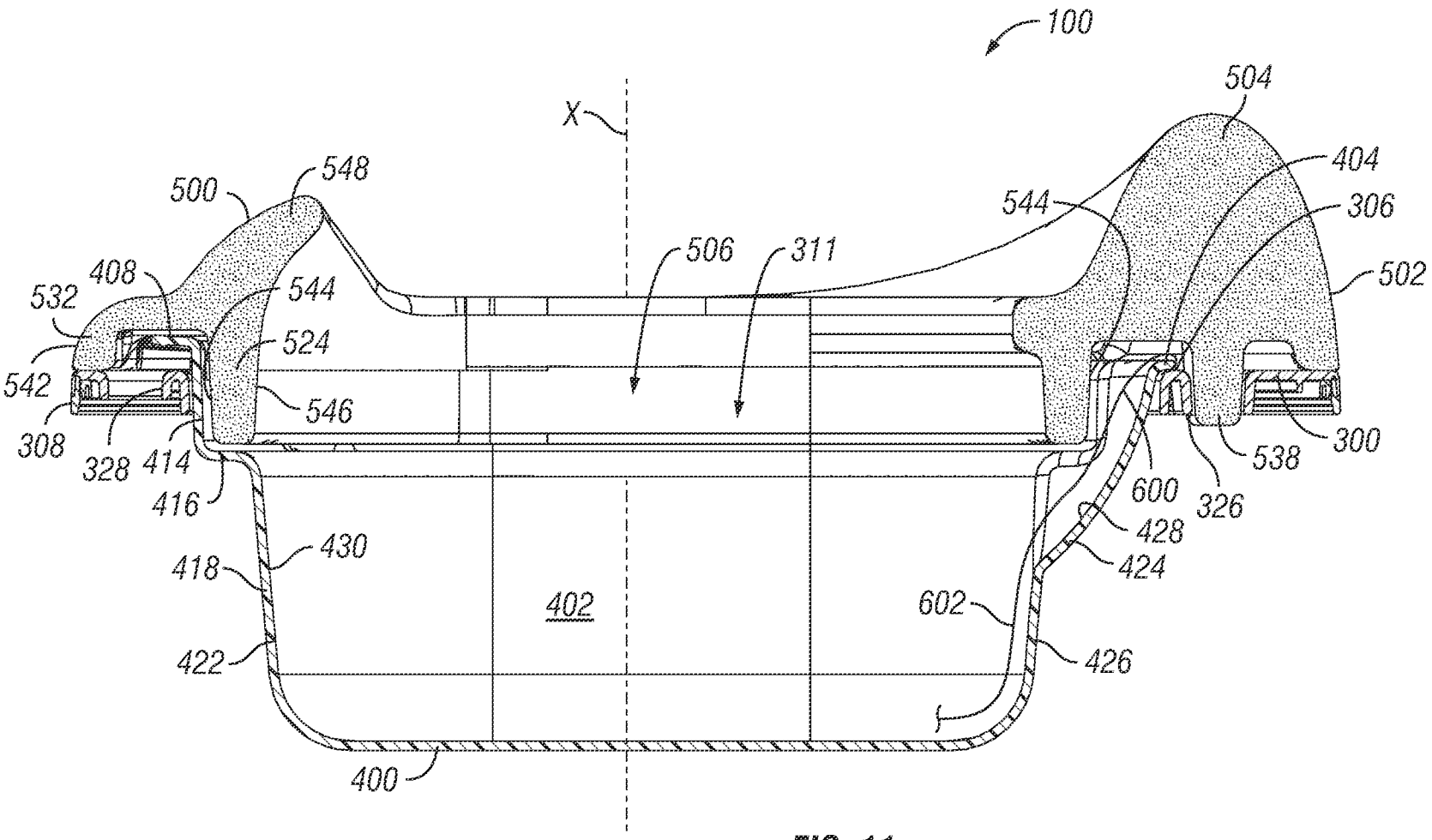
FIG. 11 is a longitudinal sectional view taken substantially along Line 11-11 of FIG. 1, the base being omitted but showing the use of an optional liner.

FIG. 11 is a longitudinal section showing the assembly, in the first configuration, of the basin 400, platform 300 and topper 500. FIG. 12 is a diagonal vertical section, taken through axis X and through the left lugs and lug notch 324, 440 and 530. The basin 400 is keyed to the platform 300, and the topper 500 is keyed to the basin 400 and platform 300, so that these parts will fit together in only one way. The outer surface 444 of the second basin lug 440 fits to the platform second lug notch 324. The outer surface 536 of the second topper lug 530 in turn fits to the inner surface 442 of the second basin lug 440. Therefore, lug notch 324 receives basin lug 440, and basin lug 440 in turn receives topper lug 530. As assembled in the first configuration, the arrangement of first lug notch 322 and corresponding first basin lug 434 and first topper lug 528 is similar to the arrangement of the other lug set just described.

As assembled, topper ring 524 extends through platform central opening 311 and into basin hollow interior 402.

As seen in FIGS. 11 and 12, optionally a wall 600 of a thin, flexible, fluid impermeable basin liner 602 may be drawn between top surface 407 of the support flange 404 and the bottom surface 526 of the topper 500, then folded around the outer margin 409 of the basin support flange 404, then clamped between bottom surface 405 of the basin support flange 404 and the top surface 306 of the platform 300. In this way, the liner 602 does not come into contact with the anatomy of the training child. The liner 602 may be plastic and may have a fluid-absorbent pad (not shown) on its interior surface.

While lug/lug notch sets 322, 434, 528; 324, 440, 530 are designed to closely conform to each other once assembled, it is otherwise at the rear of system 100. As seen in FIG. 11, an outer surface 544 of topper ring 524 intentionally is radially inwardly spaced from the inner surface 428 of pour spout 424. This is so that effluent and other matter present on the pour spout inner surface 428 does not soil the topper 500, making the latter easier to keep clean. Instead of fitting ring 524 closely to pour spout inner surface 428, the keying function is performed at this location by inserting topper blade 538 into, and in the illustrated embodiment through, the platform blade receptacle 326. This is more important in the instance that the optional liner 602 is not used.

As assembled in the first configuration, an inner surface 546 of the topper ring 524 may be in general alignment with the inner surface 430 of basin lower portion 418. The lateral width of basin step 416 is largely occupied by a thickness of topper ring 524 between the outer surface 544 and the inner surface 546 thereof.

To accommodate the potty training of boys, a urine shield 548 may upwardly and inwardly extend from topper ring 524 in the region near front topper end 532.

FIG. 13 illustrates the system 100 being used in its second configuration, as an adapter for an adult toilet 1300. The base 200 is inverted, such that its top rim 202 contacts the floor 1302. The bottom surface 208 of the base 200 acts as a step surface for the child to ascend to the top of the adult toilet seat 1304. The basin 400, liner 602 and platform 300 are not used. The topper 500 is placed so as to span the central opening of the adult toilet seat 1304.

In summary, a potty training system configurable to either of a first or a second configuration has been shown and described. The platform, basin and topper components are keyed to each other for error-free assembly. A blade in the topper is keyed to a blade receptacle in the platform, so that conformance to an inner surface of a basin pour spout is avoided.

While an illustrated embodiment of the present invention have been described and illustrated in the appended drawings, the present invention is not limited thereto but only by the scope and spirit of the appended claims.

We claim:

1. A potty training system comprising:

a hollow base having a top rim and disposed on a vertical axis;

a platform removably mounted on the top rim of the base and having a platform central opening defined by a circumferential platform inner margin, the platform having a platform top surface and a platform bottom surface;

a basin with a top margin and a hollow interior bounded by a circumferential basin sidewall, the basin sidewall having a basin end wall, an inner surface of the basin end wall bounding the hollow interior of the basin, an outer surface of the basin end wall opposed to the inner surface of the basin end wall, a support flange laterally outwardly extending from the basin top margin, the basin sidewall adapted to be removably received in the platform central opening such that the support flange supports the basin on the platform, a pour spout formed to radially outwardly protrude from the outer surface of the basin end wall, a pour spout outer surface being a portion of the outer surface of the basin end wall, a pour spout inner surface being a portion of the inner surface of the basin end wall; and a topper removably mounted on the platform, a topper central opening communicating with the hollow interior of the basin, the topper having a topper lower surface facing the basin, a topper ring downwardly extending from the topper lower surface, through the platform central opening and into the hollow interior of the basin when the topper is mounted on the platform, a topper ring outer surface laterally inwardly spaced from the pour spout inner surface;

wherein an end portion of the platform inner margin has a radially outwardly extending pour spout notch adapted to receive the pour spout outer surface, a blade receptacle formed in the platform to downwardly extend from the platform top surface and to be spaced laterally outwardly from the pour spout notch; and wherein a topper blade downwardly depends from the topper lower surface, the topper blade being radially outwardly spaced from the topper ring and adapted to be received in the blade receptacle of the platform when the topper is assembled to the platform.

2. The system of claim 1, wherein a cross section of the topper blade taken at right angles to the axis is noncircular.

3. The system of claim 1, wherein the basin sidewall has a first basin lug formed to downwardly extend from the support flange of the basin and to laterally outwardly protrude from the outer surface of the basin sidewall, the first basin lug angularly spaced around the vertical axis from the pour spout of the basin, the first basin lug having an outer surface and an opposed inner surface;

a first platform lug notch formed in the platform inner margin to be angularly spaced from the pour spout notch around the vertical axis, the first platform lug notch adapted to receive the outer surface of the first basin lug; and a first topper lug formed to outwardly protrude from the outer surface of the topper ring, the first topper lug angularly spaced around the vertical axis from the topper blade, the first topper lug being received by the inner surface of the first basin lug when the topper is assembled to the platform and basin.

4. The system of claim 3, wherein the first basin lug is substantially semicylindrical.

5. The system of claim 3, wherein the basin end wall is a basin rear end wall, the basin sidewall further including a basin front end wall opposed to the basin rear end wall, the first basin lug being located in the basin front end wall.

6. The system of claim 1, wherein most of the support flange of the basin conforms to a horizontal plane, the basin end wall being a basin rear end wall, the basin sidewall having a basin front end wall opposed to the basin rear end wall, a raised basin handle formed in the support flange to be adjacent to the basin front end wall.

7. The system of claim 1, wherein the end wall of the basin is a rear end wall, a front end wall of the sidewall of the basin being opposed to the rear end wall, a length from the front end wall to the rear end wall through the axis being greater than a width between points on the sidewall of the basin taken through the axis and to be perpendicular to the length.

8. The system of claim 1, wherein the basin sidewall has an upper portion and a lower portion, a circumferential and horizontally extending step joining the upper portion to the lower portion, the lower portion of the basin sidewall having an inner surface, the topper ring having an inner surface opposed to the topper ring outer surface, the topper ring inner surface being substantially aligned with the inner surface of the lower portion of the basin sidewall when the topper and the basin are assembled to the platform.

9. The system of claim 8, wherein the pour spout of the basin outwardly protrudes from both the upper portion of the basin sidewall and the lower portion of the basin sidewall, the inner surface of the pour spout not being stepped.

10. The system of claim 1, wherein the platform blade receptacle extends from the platform top surface to the platform bottom surface.

11. The system of claim 1, wherein the topper is formed of a foamed elastomer.

12. The system of claim 11, wherein the elastomer is ethylene vinyl acetate (EVA).

13. The system of claim 1, wherein the topper has a front end, a urine shield upwardly and inwardly extending from the topper ring at the front end of the topper.

14. The system of claim 1, wherein the inner surface of the pour spout upwardly extends to and through the support flange of the basin.

15. The system of claim 1, further including a flexible and fluid-impermeable liner for insertion into the hollow interior of the basin, the support flange having a top surface and a bottom surface, a wall of the liner fitted over the top surface of the support flange and drawn underneath the bottom surface of the support flange to be clamped between the bottom surface of the support flange and the platform top surface.

16. The system of claim 1, wherein the system is configurable into each of first and second configurations, the base having a bottom surface, wherein in the first configuration the basin is suspended by the support flange on the platform top surface, the platform bottom surface is supported by the top rim of the base, and the topper is supported by the platform top surface; and wherein in the second configuration, the base is inverted such that the top rim of the base contacts a floor and such that the bottom surface of the base faces upward to become a step surface, the basin and platform are not used, and the topper is removed from the base to be placed to span a central opening of an adult toilet seat.

17. The system of claim 16, wherein the topper has an outer margin with a left side and a right side, a left handle outwardly extending from the left side of the topper and supported by the left wing of the platform, a right handle outwardly extending from the right side of the topper and supported by the right wing of the platform, the left and right handles having bottom surfaces, a right hand cutout formed as a cavity in the bottom surface of the right handle and a left hand cutout formed as a cavity in the bottom surface of the left handle.

18. A potty training system comprising:

a hollow base disposed on a vertical axis and having a top rim;

a platform removably mounted on the top rim of the base and having a platform central opening defined by a circumferential platform inner margin, the platform having a platform top surface and a platform bottom surface;

a basin with a hollow interior bounded by a circumferential basin sidewall extending around the axis, the basin having a basin top margin, a basin sidewall downwardly extending from the basin top margin and having a basin rear end wall and a basin front end wall opposed to the basin front end wall, an inner surface of the basin rear end wall bounding the hollow interior of the basin, an outer surface of the basin rear end wall opposed to the inner surface of the basin rear end wall, a support flange laterally outwardly extending from the basin top margin, the sidewall of the basin adapted to be removably received in the platform central opening such that the support flange supports the basin on the platform top surface, a pour spout formed to laterally outwardly protrude from the outer surface of the basin rear end wall, a pour spout outer surface being a portion of the outer surface of the basin end wall, a pour spout inner surface being a portion of the inner surface of the basin end wall; and a topper removably mounted on the platform, a topper central opening communicating with the hollow interior of the basin, the topper having a topper lower surface facing the basin, a topper ring downwardly extending from the topper lower surface, through the platform central opening and into the hollow interior of the basin when the topper is mounted on the platform, a topper ring outer surface inwardly spaced from the pour spout inner surface;

wherein a rear end portion of the platform margin has an outwardly extending pour spout notch adapted to receive the pour spout outer surface, a blade receptacle formed in the platform to downwardly extend from the platform top surface, the blade receptable spaced laterally outwardly from the pour spout notch; and wherein a topper blade downwardly depends from the topper lower surface, the topper blade outwardly spaced from the topper ring and adapted to be received in the blade receptacle of the platform when the topper is assembled to the platform;

first and second basin lugs each formed to downwardly extend from the support flange of the basin and to laterally outwardly protrude from the outer surface of the basin sidewall, the first basin lug disposed in the basin front end wall to be angularly spaced around the axis from the pour spout, the second basin lug disposed in the basin front end wall to be angularly spaced around the axis from the first basin lug and from the pour spout;

first and second platform lug notches formed in the platform inner margin to be angularly spaced around the axis from the pour spout notch and from each other, the first platform lug notch adapted to receive the outer surface of the first basin lug, the second platform lug notch adapted to receive the outer surface of the second basin lug; and first and second topper lugs formed to outwardly protrude from the outer surface of the topper ring, the first topper lug angularly spaced around the axis from the topper blade, the second topper lug angularly spaced around the axis from the topper blade and the first topper lug, the first topper lug being received by the inner surface of the first basin lug and the second topper lug being received by the inner surface of the second basin lug when the topper is assembled to the platform and basin.

19. The system of claim 18, wherein the first and second topper lugs and the topper ring each have a depth in alignment with the axis, the depths of the first and second topper lugs being substantially the same as the depth of the topper ring.

* * * * *